US007853190B2

(12) United States Patent
Shimizu et al.

(10) Patent No.: US 7,853,190 B2
(45) Date of Patent: Dec. 14, 2010

(54) FIXING DEVICE, CARRYING DEVICE AND IMAGE FORMING APPARATUS

(75) Inventors: Yosuke Shimizu, Toyokawa (JP); Etsuaki Urano, Okazaki (JP); Masanori Murakami, Toyohashi (JP); Keisuke Inoue, Toyokawa (JP); Tomohiko Masuda, Otsu (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 391 days.

(21) Appl. No.: 11/868,622

(22) Filed: Oct. 8, 2007

(65) Prior Publication Data

US 2009/0003900 A1 Jan. 1, 2009

(30) Foreign Application Priority Data

Oct. 10, 2006 (JP) ..... 2006-276389
Oct. 5, 2007 (JP) ..... 2007-262264

(51) Int. Cl.
*G03G 15/20* (2006.01)

(52) U.S. Cl. ..... 399/329

(58) Field of Classification Search ..... 399/107, 399/122, 320, 328, 329, 303; 219/216, 619
See application file for complete search history.

(56) References Cited

U.S. PATENT DOCUMENTS 5,950,060 A 9/1999 Isogai
7,020,423 B2 3/2006 Ono et al.
7,299,003 B2 11/2007 Kurotaka et al.
7,427,729 B2 * 9/2008 Asakura et al. ..... 219/619

FOREIGN PATENT DOCUMENTS

| | | |
|---|---|---|
| JP | 10-198211 | 7/1998 |
| JP | 11-202666 A | 7/1999 |
| JP | 2002-139936 | 5/2002 |
| JP | 2002-182501 A | 6/2002 |
| JP | 2003-098877 | 4/2003 |
| JP | 2004-226819 | 8/2004 |
| JP | 2005-241953 | 9/2005 |
| JP | 2006-189690 A | 7/2006 |

OTHER PUBLICATIONS

Preliminary Notice of Rejection in JP 2007-262264 dated Sep. 16, 2008, and a English Translation thereof.

* cited by examiner

*Primary Examiner*—Hoan Tran
(74) *Attorney, Agent, or Firm*—Buchanan Ingersoll & Rooney PC

(57) ABSTRACT

A conveying device includes a cylindrical first roller, a cylindrical second roller that has a surface hardness higher than a surface hardness of the first roller, and a belt placed in a state surrounding either the first roller or the second roller. the conveying device moves an object to be conveyed by bringing the first roller and the second roller in pressure contact with each other via the belt and making the object pass through a nip portion formed of the belt and the first roller or the second roller facing the belt. A length in a lengthwise direction of an outer peripheral portion of the first roller is shorter than a length in a lengthwise direction of an outer peripheral portion of the second roller.

17 Claims, 11 Drawing Sheets

Fig.10
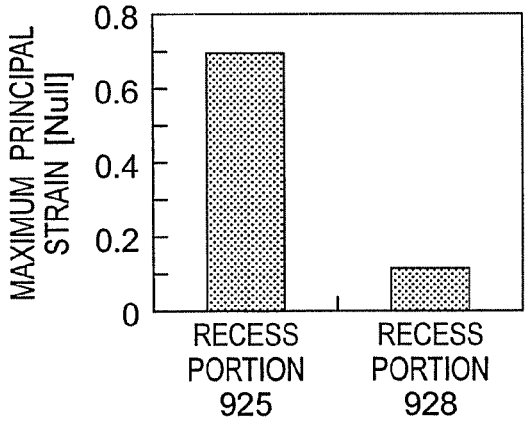
Fig.11
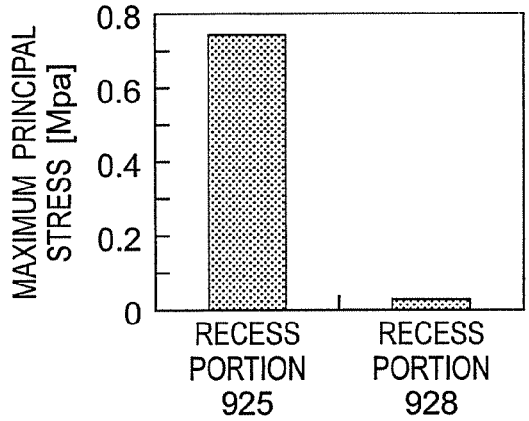
Fig.12
| | CONTINUOUS DRIVE TIME [h] | | | | | |
|---|---|---|---|---|---|---|
| | 0 | 200 | 400 | 600 | 800 | 1000 |
| NO RECESS PORTION | 2h | | | | | |
| WITH RECESS PORTION 925 $\theta_1$=90° | 320h | | | | | |
| WITH RECESS PORTION 928 $\theta_1$=61.3° | >1000h | | | | | |

FIXING DEVICE, CARRYING DEVICE AND IMAGE FORMING APPARATUS

This Nonprovisional application claims priority under 35 U.S.C. §119(a) on Patent Applications No. 2006-276389 and No. 2007-262264 filed in Japan on Oct. 10, 2006 and Oct. 5, 2007, respectively, the entire contents of which are hereby incorporated by reference.

BACKGROUND OF THE INVENTION

The present invention relates to image forming apparatuses such as printers, copying machines, facsimiles or complex machines that have the functions of them in a complex form and to fixing devices and conveying devices for use in the image forming apparatuses.

In an electrophotographic image forming apparatus, a developer carried on a sheet that is an image carrier is fixed to the sheet by applying heat and a pressure to it. For the above purpose, a roller made of a solid rubber or the like has conventionally been used as heating means for heating the sheet and the developer in a fixing device incorporated in the image forming apparatus. However, a belt-type fixing device employing a fixing belt that has an excellent thermal efficiency and a smaller thermal capacity than that of the roller to allow the temperature to rise in a short time and is consequently able to shorten a warmup time has lately been used.

One example of the belt-type fixing device is disclosed in JP 2006-189690 A. In this case, the belt-type fixing device disclosed in JP 2006-189690 A has an endless fixing belt, a fixing roller and a heating roller that are located inside the fixing belt and support the fixing belt, and a pressure roller that is located outside the fixing roller and holds the fixing belt with the fixing roller. The fixing roller and the pressure roller are designed to have the same length in the lengthwise direction. A heat source (halogen lamp) is built in the heating roller and the pressure roller. Therefore, the heat sources of the heating roller and the pressure roller are supplied with an electric power during the fixing, so that the sheet and the developer supplied in between the fixing belt and the pressure roller are heated by heat supplied from the heating roller and the pressure roller heated by the heat sources, fixing the developer to the sheet.

The outer peripheral surfaces of the rollers such as the fixing roller and the pressure roller used for the belt-type fixing device as described above are each covered with an elastic layer. The elastic layer, which has excellent deformability, forms a large contact region (nip portion, nip region) between the fixing belt and the pressure roller. With this arrangement, a sufficient fixing time can be secured when the sheet is conveyed at high speed. Moreover, the elastic layer of the fixing roller is softly set, and the elastic layer of the pressure roller is set harder than that of the fixing roller, so that the nip portion is formed curved convex to the fixing roller. With this arrangement, the leading end of the sheet discharged from the nip portion is directed toward a direction in which it is separated away from the fixing belt, so that the sheet can easily be separated from the fixing belt.

However, when a belt of a laminate structure including a metal layer is used in the belt-type fixing device that has the hard pressure roller and the soft fixing roller as described above, it is concerned that an excessive stress is given to the belt depending on the contact condition of the hard pressure roller and the soft fixing roller. For example, the soft elastic layer in the outer peripheral portion of the fixing roller is expanded in the lengthwise direction thereof, and the edge portions of the belt are bent toward the pressure roller. As a result, fixation of the developer is insufficient in both side end portions of the sheet, or a disorder of the image occurs as a consequence of the outward movement of the unfixed developer toward the end portions. Since developers of a plurality of colors are layered on the sheet particularly in a full-color image forming apparatus, the disorder of the image often occurs. Moreover, when the fixing belt includes a metal layer (electromagnetic induction heating layer), an excessive bending stress is generated in the metal layer, possibly causing cracks.

SUMMARY OF THE INVENTION

An object of the present invention is to provide a belt-type conveying device, which does not give an excessive stress to the belt.

Another object of the present invention is to provide a belt-type fixing device, which does not give an excessive stress to the belt and is able to eliminate the problems of the disorder of the image and the breakage of the metal layer in advance.

A yet another object of the present invention is to provide an image forming apparatus that has the conveying device and the fixing device.

According to a first aspect, the present invention is a conveying device comprising:

a cylindrical first roller;

a cylindrical second roller that has a surface hardness higher than a surface hardness of the first roller; and a belt placed in a state surrounding either the first roller or the second roller, the conveying device moving an object to be conveyed by bringing the first roller and the second roller in pressure contact with each other via the belt and making the object pass through a nip portion formed of the belt and the first roller or the second roller facing the belt, wherein a length in a lengthwise direction of an outer peripheral portion of the first roller is shorter than a length in a lengthwise direction of an outer peripheral portion of the second roller.

According to the conveying device of the present invention, even when the first roller and the second roller are brought in pressure contact with each other via the belt and the outer peripheral portion of the first roller expands in the lengthwise direction, the expanded end portion of the outer peripheral portion of the first roller can be aligned in position approximately with the end portion of the outer peripheral portion of the second roller. With this arrangement, the problem that an excessive stress is given to the belt is eliminated.

According to a second aspect, the present invention is a conveying device comprising:

a cylindrical first roller;

a cylindrical second roller that has a surface hardness higher than a surface hardness of the first roller; and a belt tensionally looped over the first roller or the second roller and the third roller, the conveying device moving an object to be conveyed by bringing the first roller and the second roller in pressure contact with each other via the belt and making the object pass through a nip portion formed of the belt and the first roller or the second roller facing the belt, wherein a length in a lengthwise direction of an outer peripheral portion of the first roller is shorter than a length in a lengthwise direction of an outer peripheral portion of the second roller.

According to the conveying device of the present invention, as in the first aspect, even when the first roller and the second roller are brought in pressure contact with each other via the belt and the outer peripheral portion of the first roller expands in the lengthwise direction, the expanded end portion of the outer peripheral portion of the first roller can be aligned in position approximately with the end portion of the outer peripheral portion of the second roller. With this arrangement, the problem that an excessive stress is given to the belt is eliminated.

In the conveying device of one embodiment, a difference between the length in the lengthwise direction of the outer peripheral portion of the first roller and the length in the lengthwise direction of the outer peripheral portion of the second roller is not smaller than 2 mm.

According to a third aspect, the present invention is an image forming apparatus comprising the conveying device of the first or second aspect.

In the image forming apparatus of the present invention, by constituting the fixing device employing the conveying device, the occurrence of insufficient fixation at the end portion of the sheet is reduced even when the thickness of the toner particle layer is thick, and a variation in the pressurizing force applied to the sheet is reduced in the lengthwise direction of the roller. Therefore, an image that is entirely uniform and clear can be obtained. Moreover, deformations of curves and the like are reduced at the end portions of the sheet.

According to a fourth aspect, the present invention is a fixing device comprising:

a cylindrical fixing roller;

a cylindrical pressure roller that has a surface hardness higher than a surface hardness of the fixing roller; and a fixing belt placed in a state surrounding an outer peripheral surface of the fixing roller, the fixing device fixing toner particles on a sheet by making the sheet that has a toner image on it pass through a nip portion formed of the pressure roller and the fixing belt by bringing the fixing roller and the pressure roller in pressure contact with each other via the fixing belt, wherein a length in a lengthwise direction of an outer peripheral portion of the fixing roller is shorter than a length in a lengthwise direction of an outer peripheral portion of the pressure roller.

According to the present invention, even when the fixing roller and the pressure roller are brought in pressure contact with each other via the fixing belt and the outer peripheral portion of the fixing roller is expanded in the lengthwise direction, the expanded end portion of the outer peripheral portion of the fixing roller can be aligned in position approximately with the end portion of the outer peripheral portion of the pressure roller. With this arrangement, an excessive stress is prevented from being given to the fixing belt, and the problems of the disorder of the image and the breakage of the metal layer described above are eliminated.

Further, according to a fifth aspect, the present invention is a fixing device comprising:

a cylindrical fixing roller;

a cylindrical pressure roller that has a surface hardness higher than a surface hardness of the fixing roller; and a fixing belt tensionally looped over the fixing roller and the support roller, the fixing device fixing toner particles on a sheet by making the sheet that has a toner image on it pass through a nip portion formed of the pressure roller and the fixing belt by bringing the fixing roller and the pressure roller in pressure contact with each other via the fixing belt, wherein a length in a lengthwise direction of an outer peripheral portion of the fixing roller is shorter than a length in a lengthwise direction of an outer peripheral portion of the pressure roller.

According to the fixing device of the present invention, as in the fourth aspect, even when the fixing roller and the pressure roller are brought in pressure contact with each other via the fixing belt and the outer peripheral portion of the fixing roller is expanded in the lengthwise direction, the expanded end portion of the outer peripheral portion of the fixing roller can be aligned in position approximately with the end portion of the outer peripheral portion of the pressure roller. With this arrangement, an excessive stress is prevented from being given to the fixing belt, and the problems of the disorder of the image and the breakage of the metal layer described above are eliminated.

In the fixing device of one embodiment, the outer peripheral portion of the fixing roller has a recess portion in an end region other than a region where the sheet passes in the lengthwise direction, and the length in the lengthwise direction of the outer peripheral portion of the fixing roller is shorter than the length in the lengthwise direction of the fixing belt.

In the fixing device of the present one embodiment, the outer peripheral portion of the fixing roller has the recess portion in the lengthwise end regions other than the region through which the sheet passes. Therefore, even when the end portion of the outer peripheral portion of the fixing roller attempts to expand in the lengthwise direction as the result that the fixing roller and the pressure roller are brought in pressure contact with each other via the fixing belt, it becomes possible to restrain the end portion from expanding beyond filling up the recess portion. With this arrangement, an excessive stress is prevented from being given to the fixing belt, and the problems of the disorder of the image and the breakage of the metal layer described above are eliminated.

In the fixing device of one embodiment, a difference between the length in the lengthwise direction of the outer peripheral portion of the fixing roller and the length in the lengthwise direction of the outer peripheral portion of the pressure roller is not smaller than 2 mm.

In the fixing device of one embodiment, the surface hardness of the fixing roller is within a range of 10 degrees to 30 degrees by Asker C hardness, and the surface hardness of the pressure roller is within a range of 50 degrees to 80 degrees by the Asker C hardness. In the fixing device of one embodiment, the outer peripheral portion of the fixing roller comprises foam of resin or rubber as an elastic layer.

In the fixing device of one embodiment, the length in the lengthwise direction of the outer peripheral portion of the fixing roller is shorter than a width of the fixing belt.

The fixing device of one embodiment comprises an electromagnetic induction type heating part to heat the fixing belt.

In the fixing device of one embodiment, a length and a height of the recess portion provided in the end region of the outer peripheral portion of the fixing roller are not smaller than 2 mm and not smaller than 1 mm, respectively, in a cross section that contains a central axis of the fixing roller and is parallel to the lengthwise direction.

In the fixing device of one embodiment, the elastic layer of the fixing roller comprises an inclined portion whose outside diameter dimension is continuously reduced outwardly in the lengthwise direction in both end regions other than a region where the sheet passes in the lengthwise direction.

The phrase of "continuously reduced" herein means a gradual reduction toward the outside in the lengthwise direction excluding the case of a reduction in a perpendicular step in the lengthwise direction.

In the fixing device of the present one embodiment, the elastic layer of the fixing roller has the recess portion formed of the inclined portion in the lengthwise end regions other than the region through which the sheet passes.

In the fixing device of one embodiment, the elastic layer of the fixing roller comprises a flat portion which is outwardly continuous to the inclined portion and whose outside diameter dimension is constant in both end regions other than the region where the sheet passes in the lengthwise direction.

In the fixing device of the present one embodiment, the elastic layer of the fixing roller has the recess portion formed of the inclined portion and the flat portion in the lengthwise end regions other than the region through which the sheet passes. In this case, the outside diameter dimension of the outer end surface (outer end surface in the lengthwise direction) of the elastic layer can easily be secured to a certain extent. Therefore, the meander regulation member for preventing the meander of the fixing belt can easily be positioned in contact with the outer end surface of the elastic layer. With this arrangement, the meander of the fixing belt can effectively be prevented.

In the fixing device of one embodiment, the inclined portion is bent at an angle of not smaller than 20° not greater than 65° with respect to the outer peripheral surface of the elastic layer in the region where the sheet passes in a cross section that contains the central axis of the fixing roller and is parallel to the lengthwise direction.

In the fixing device of the present one embodiment, the inclined portion is bent at the angle of not smaller than 20° with respect to the outer peripheral surface of the elastic layer in the region where the sheet passes in a cross section that contains the central axis of the fixing roller and is parallel to the lengthwise direction. Therefore, the height (space) of the recess portion can easily be secured while suppressing the length of the recess portion. On the other hand, the inclined portion is bent at the angle of not greater than 65° with respect to the outer peripheral surface of the elastic layer in the region through which the sheet passes. Therefore, a shearing stress applied to the inclined portion and its neighborhood portions of the elastic layer can be eased in the state in which the fixing roller and the pressure roller are brought in pressure contact with each other via the fixing belt in comparison with a case where the inclined portion is bent at an angle of, for example, 90° with respect to the outer peripheral surface of the elastic layer in the region through which the sheet passes. Therefore, the elastic layer becomes able to endure being driven for a long time, and the reliability is improved.

In the fixing device of one embodiment, the inclined portion of the elastic layer is bent or bent and raised in a curve at an angle that exceeds 0° and is not greater than 65° with respect to an outer peripheral surface of the flat portion of the elastic layer in a cross section that contains the central axis of the fixing roller and is parallel to the lengthwise direction.

In the fixing device of the present one embodiment, the inclined portion of the elastic layer is bent or raised in a curve at an angle that exceeds 0° and is not greater than 65° with respect to the outer peripheral surface of the flat portion of the elastic layer. Therefore, shearing stress applied to the inclined portion and its neighborhood portions of the elastic layer can be eased. Therefore, the elastic layer becomes able to endure being driven for a long time, and the reliability is improved.

In the fixing device of one embodiment, the inclined portion of the elastic layer is linear in a cross section that contains the central axis of the fixing roller and is parallel to the lengthwise direction.

In the fixing device of the present one embodiment, the inclined portion of the elastic layer is linear, and therefore, the processing and the dimension control of the elastic layer become easy.

Further, according to a sixth aspect, the present invention is an image forming apparatus that comprises the fixing device of the fourth or fifth aspect.

According to the image forming apparatus of the present invention, by employing the fixing device, the occurrence of insufficient fixation at the end portion of the sheet is reduced even when the thickness of the toner particle layer is thick, and a variation in the pressurizing force applied to the sheet is reduced in the lengthwise direction of the roller. Therefore, an image that is entirely uniform and clear can be obtained. Moreover, deformations of curves and the like are reduced at the end portions of the sheet.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 10 is a graph showing a maximum principal strain of the elastic layer of the fixing roller when the fixing roller and the pressure roller are brought in pressure contact with each other via a fixing belt by comparison between the case where the recess portion shown in FIG. 6 is provided and the case where the recess portion shown in FIG. 7C is provided;

FIG. 11 is a graph showing a maximum principal stress of the elastic layer of the fixing roller when the fixing roller and the pressure roller are brought in pressure contact with each other via the fixing belt by comparison between the case where the recess portion shown in FIG. 6 is provided and the case where the recess portion shown in FIG. 7C is provided;

FIG. 12 is a graph showing the results of durability when the fixing device is continuously driven by comparison among an unattended case of "no recess portion", the case where the recess portion shown in FIG. 6 is provided and the case where the recess portion shown in FIG. 7C is provided;

DETAILED DESCRIPTION OF THE INVENTION

Figure 1:
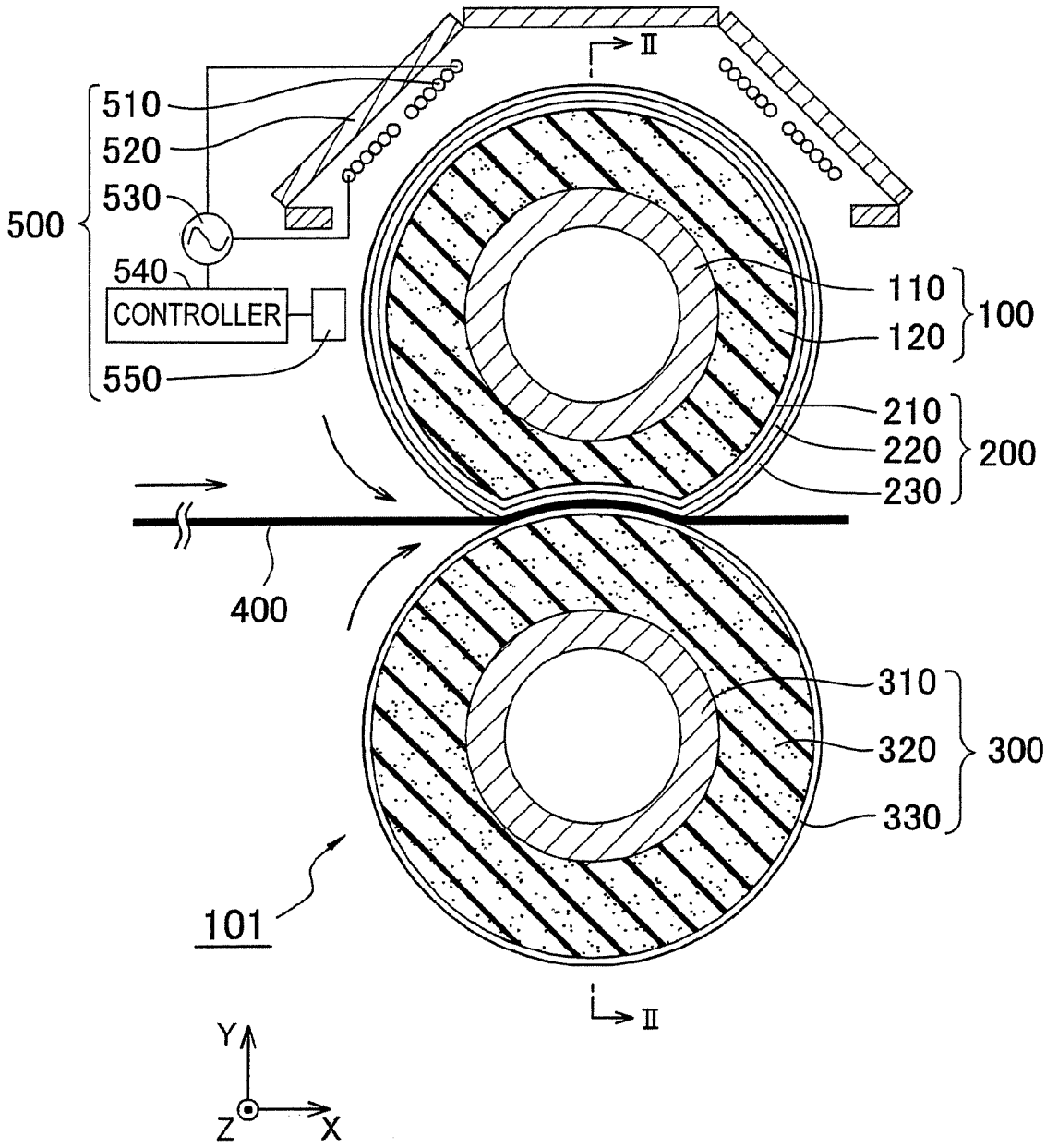
FIG. 1 is a sectional view of a fixing device according to a first embodiment of the present invention.

Embodiments of the present invention are described in detail below on the basis of the accompanying drawings. In the following description, terms that indicate specific directions and positions (e.g., the terms of "upper", "lower", "right" and "left" and other terms including the terms) are used as occasion demands. However, the use of those terms is intended to facilitate the understanding of the invention with reference to the drawings, and the technical scope of the present invention is not limited by the meanings of those terms. Moreover, portions of identical reference numerals appearing in a plurality of figures denote identical portions or members.

The First Embodiment

Figure 2:
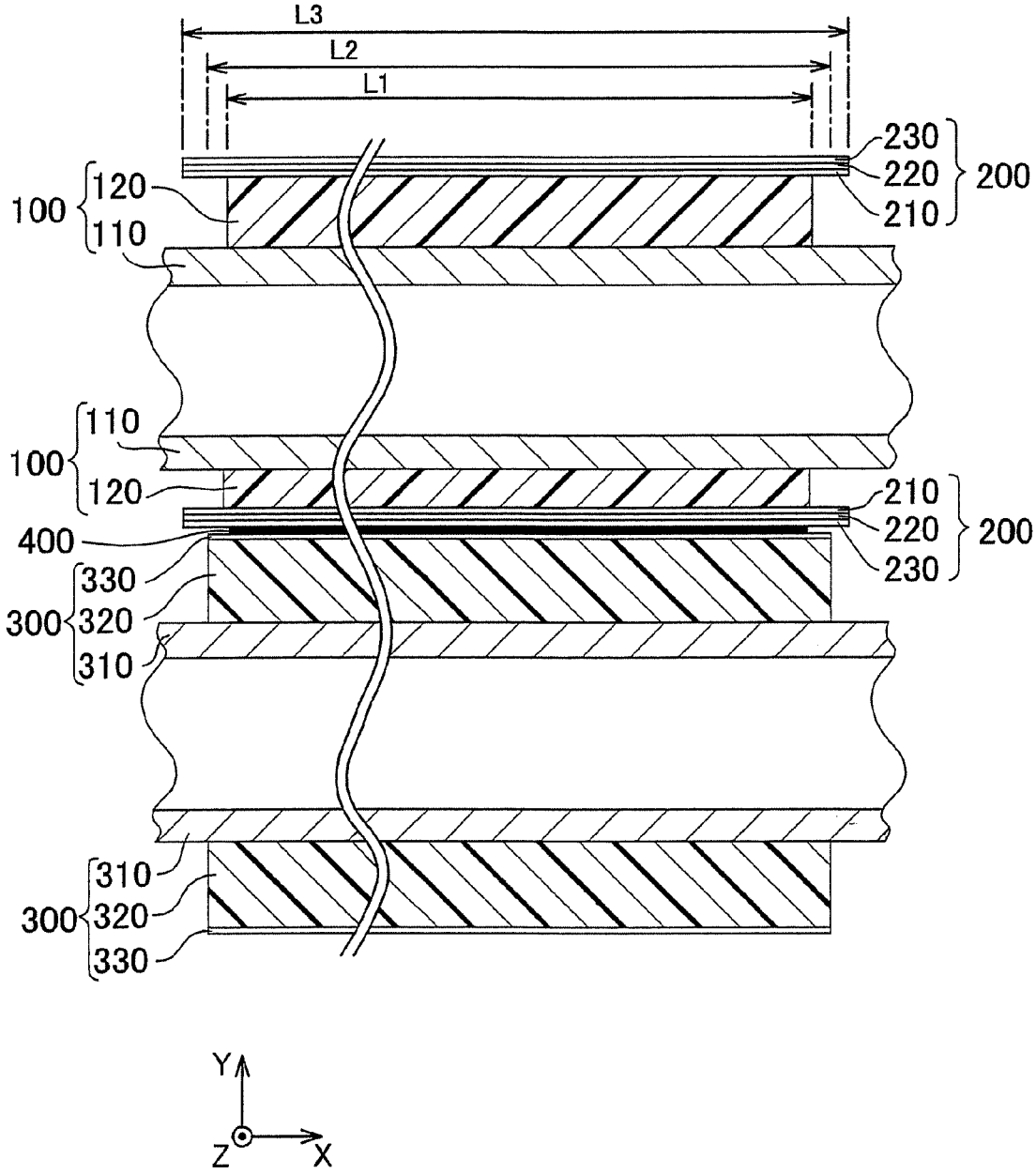
FIG. 2 is a sectional view taken along the line II-II of the fixing device shown in FIG. 1.

FIG. 1 is a side view of the fixing device of an electrophotographic image forming apparatus (e.g., copying machine, printer, facsimile, complex machine) according to the first embodiment of the present invention, the apparatus being entirely denoted by the reference numeral 101. FIG. 2 is a sectional view of the fixing device viewed from the direction II-II of FIG. 1. The cross section in FIG. 2 contains in its plane the central axes of two rollers 100, 300 (not shown) described later.

Referring to the figure, the fixing device 101 has a heating roller 100 as a first roller, and a pressure roller 300 as a second roller placed parallel to the heating roller 100. The heating roller 100 is externally provided with a cylindrical fixing belt 200 that has an inside diameter exactly identical or approximately identical to the outside diameter of the heating roller 100 or slightly larger than the outside diameter of the heating roller 100, and the heating roller 100 and the pressure roller 300 are put in pressure contact with each other via the fixing belt 200.

The fixing roller 100 has a core metal 110. The core metal 110 is constructed of a hollow or solid cylindrical body and rotatably supported to the main body of the image forming apparatus via a bearing (not shown). In the present embodiment, the core metal 110 is provided by, for example, an aluminum pipe that has an outside diameter of 20 mm and a thickness of 4 mm. The material used for the core metal 110 is only required to have a strength such that the fixing roller does not excessively bend during use and is allowed to be provided by, for example, a pipe of steel, stainless steel or a resin mold of PPS (polyphenylene sulfide) or the like besides aluminum. As described later, when the electromagnetic induction heating system is adopted for the heating of the fixing belt 200, the core metal 110 should preferably be formed of a nonmagnetic material in order to prevent the core metal 110 from being heated by electromagnetic induction waves.

The outer periphery of the core metal 110 is covered with an elastic layer 120 that has a heat-insulating property except for parts on both end sides (see FIG. 2). In this example, the elastic layer 120 constitutes the outer peripheral portion of the fixing roller 100. A material having a heat-insulating property is used for the elastic layer 120 so that the heat of the fixing belt 200 raised in temperature to a prescribed temperature to heat toner particles of the developer does not diffuse through the fixing roller 100. As shown in FIG. 1, the elastic layer 120 should desirably be formed of a material that has hardness lower than that of the pressure roller 300 and is easily deformed by compression when a pressure is applied thereto in order to form a nip portion (hereinafter referred to as a "nip region") in a contact region that has a prescribed length in the circumferential direction between the fixing belt 200 and the pressure roller 300 put in pressure contact with it.

As a material that has heat resistance, deformability and hardness as described above, a foam (heat-insulated structure body) of rubber or resin can be used. A preferable example of the elastic layer 120 is a silicone rubber foam. The elastic layer 120 is not required to have a single-layer structure but allowed to have a structure in which a plurality of layers of foams of different kinds are layered or a structure in which nonfoam and foam are alternately layered. When the silicone rubber foam is used, the elastic layer 120 should preferably have a thickness of 3 to 7 mm. It is noted that the "thickness" mentioned in the present patent application means the dimension in the nondeformed state. The hardness is 10 degrees to 60 degrees or should preferably be 10 degrees to 30 degrees or more preferably be 19 degrees to 25 degrees by an Asker rubber hardness meter (e.g., with a load of 9.8 N by an Asker C hardness meter). The elastic layer 120 of the fixing roller 100 has a length L1 of, for example, 330 mm in the lengthwise direction (direction parallel to the central axis of the roller).

When the length of the nip region in the circumferential direction is increased, an adhesive force is increased between the fixing belt and the melted toner on the sheet 400 that passes through the nip region, and it is sometimes the case where the sheet 400 cannot easily be separated from the fixing belt 200 even when a separating claw (not shown) is used. Therefore, as shown in FIG. 1, the hardness of the elastic layer 120 is made lower than the surface hardness of the pressure roller 300 so that a nip region curved convex to the fixing roller 100 is formed between the fixing belt 200 and the pressure roller 300. With this arrangement, as illustrated, the leading end of the sheet 400, which has immediately passed through the nip region, is directed in a direction (oblique lower right side in the figure) away from the fixing belt 200 and is easily separated from the fixing belt 200 due to the bending reluctance (stiffness) of the sheet 400.

The pressure roller 300 is rotatably supported to the main body of the image forming apparatus via a bearing (not shown) and operatively connected to a motor (not shown) of a driving source so as to be rotationally driven in the clockwise direction in FIG. 1 on the basis of the drive of the motor. Both bearings of the pressure roller 300 and both bearings of the fixing roller 100 are connected to each other by a pressurizing mechanism such as a spring (not shown) and put in pressure contact with each other with a force of, for example, 300 N to 500 N. With this arrangement, the fixing roller 100 is deformed by compression, and a nip region that has a prescribed length (e.g., 5 mm to 15 mm) along the outer periphery of the pressure roller 300 is formed between the pressure roller 300 and the fixing belt 200.

In the embodiment, the pressure roller 300 has a core metal 310. The core metal 310 is constructed of a hollow or solid cylindrical body. The core metal 310 is formed of, for example, an aluminum pipe that has a diameter of 20 mm and a thickness of 3 mm. Usable materials and preferable materials for the core metal 310 are the same as those of the core metal 110 of the fixing roller 100. The outer periphery of the core metal 310 is covered with an elastic layer 320 that has a heat-insulating property. The elastic layer 320 is constructed of, for example, a silicone rubber foam that has a thickness of 3 mm to 10 mm. The outer periphery of the elastic layer 320 should preferably be covered with a release layer 330. In this example, the elastic layer 320 and the release layer 330 constitute the outer peripheral portion of the pressure roller 300. As in the case of the release layer 230 of the fixing belt 200, the release layer 330 is constructed of a fluorine based resin of, for example, PTFE (polytetrafluoroethylene) or PFA (tetrafluoroethylene-perfluoroalkyl vinyl ether copolymer) to improve the release property of the sheet 400 and has a thickness of 10 μm to 50 μm. As described above, in order to form the nip region convex to the fixing roller 100, the surface hardness of the pressure roller 300 is higher than the surface hardness of the fixing roller 100. For example, when the surface hardness of the fixing roller 100 is 10 degrees to 30 degrees by the Asker C hardness, the surface hardness of the pressure roller 300 should preferably be 50 degrees to 80 degrees by the Asker C hardness.

The fixing belt 200 may have either a single-layer structure constructed of a single layer or a multilayer structure constructed of a plurality of layers. In the embodiment, the fixing belt 200 has a three-layer structure constructed of an electromagnetic induction heating layer 210 of an inner layer, an elastic layer 220 of an intermediate layer and a release layer 230 of an outer layer. In the embodiment, the electromagnetic induction heating system is adopted as the heating means of the fixing belt 200, and the fixing belt 200 is formed of a material that can be heated by electromagnetic induction in the case of the single-layer structure.

The elastic layer 220 of the fixing belt 200 is placed for the purpose of improving adhesion between the sheet 400 and the fixing belt in the nip region and reliably carrying out heating and pressurization of toner particles necessary for fixation. The material of the elastic layer 220 should preferably be a foamed material of rubber or resin such as silicone rubber or fluororubber that has heat resistance and elasticity. Preferable silicone rubber is a silicone rubber of one-component system, a two-component system or a three-component system, a silicone rubber of LTV (low-temperature vulcanization) type, RTV (room-temperature vulcanization) type or HTV (high-temperature vulcanization) type or a silicone rubber of a condensation type or an addition type.

It is acceptable to mix filler for the purpose of improving the thermal conductivity and improving the strength of the elastic layer 220. As fillers capable of improving the thermal conductivity, there are particles that have diamond, silver, copper, aluminum, marble and glass as the principal ingredients. Particles preferable as the filler are, for example, particles of silica, alumina, magnesium oxide, boron nitride and beryllium oxide.

The thickness of the elastic layer 220 should preferably be 10 μm to 800 μm, more preferably be 100 μm to 300 μm and most preferably be 150 μm to 250 μm. The desired adhesion cannot be obtained when the thickness of the elastic layer is smaller than 10 μm, and conduction of heat generated in the electromagnetic induction heating layer 210 to the toner particles is hindered when the thickness exceeds 800 μm.

The hardness of the elastic layer 220 should desirably be 10 to 30 degrees by the Asker C hardness. When the hardness is within the range, a reduction in the strength and the defective adhesion of the elastic layer 220 can be prevented, and excellent fixing property of the toner can be achieved.

The release layer 230 is placed at the outermost side of the fixing belt in order to make the sheet 400 easily separate from the fixing belt 200 after the sheet 400 has passed through the nip region. A preferable material of the release layer 230 is fluororesin of, for example, silicone rubber, fluororubber, PFA (tetrafluoroethylene-perfluoroalkyl vinyl ether copolymer), PTFE (polytetrafluoroethylene), FEP (tetrafluoroethylene-hexafluoropropylene copolymer), PFEP (perfluoroethylene-propylene copolymer) or the like. It is acceptable to add a conductive material, an abrasion-resistant material and a high heat conducting material as filler as occasion demands. The thickness of the release layer 230 should preferably be 5 μm to 100 μm, more preferably be 10 μm to 50 μm and most preferably be 30 μm to 50 μm.

It is noted that an adhesion process with a primer or the like may be carried out as occasion demands in order to improve the adhesion between the layers of the fixing belt 200 or between the fixing belt 200 and the fixing roller 100.

The electromagnetic induction heating layer 210 needs to include a material such as a metal that has an electrical conductivity so as to generate heat by electromagnetic induction heating. The material of the electromagnetic induction heating layer 210 should preferably have ferromagnetism, a comparatively high magnetic permeability and a moderate electric resistivity. As preferable materials described above, there can be enumerated ferromagnetic stainless steel of, for example, electroformed nickel and a martensitic stainless steel. The thickness of the electromagnetic induction heating layer 210 should be 10 μm to 100 μm, preferably be 20 μm to 50 μm or more preferably be 30 μm to 45 μm in order to secure a thermal capacity necessary for melting the toner.

An electromagnetic induction heater 500 has an excitation coil 510. The coil 510 is provided by covering a Litz wire obtained by, for example, twisting together ten or more thin copper wires with a heat-resistant resin. The coil 510 is placed around an upper outer peripheral surface of the fixing belt 200 so as to cover the upper outer peripheral surface and constitutes a magnetic circuit. By applying high frequency to the coil 510, alternating magnetic fields that pass through the electromagnetic induction heating layer 210 throughout the entire length in the lengthwise direction of the fixing belt 200 are uniformly formed, so that the electromagnetic induction heating layer 210 is uniformly heated by electromagnetic induction throughout the entire length. A magnetic core 520 is placed on the outside of the coil 510, so that a magnetic flux formed by electromagnetic induction is prevented from leaking to peripheral devices and the magnetic flux density of the magnetic circuit is improved. It is noted that the magnetic core 520 can be removed when there is no device that receives bad influence due to the existence of magnetism in the surroundings of the magnetic coil 510. Moreover, although not shown, a degaussing coil may be placed between the coil 510 and the core 520. Both ends of the coil 510 are connected to an induction heating power supply (alternating current source) 530. The induction heating power supply 530 has, for example, a high-frequency inverter of a rated frequency of 10 kHz to 100 kHz and a rated output of 100 W to 2,000 W. The induction heating power supply 530 is connected to a controller 540 that adjusts its output. The controller 540 is connected to a temperature sensor 550 placed in the neighborhood of the outer peripheral surface of the fixing belt 200. The temperature sensor 550, which is separated apart from the fixing belt 200 in the figure, is not required to be a noncontact type temperature sensor but allowed to be provided by a contact type temperature sensor (e.g., thermistor). With this arrangement, the controller 540 adjusts the surface temperature of the fixing belt 200 to a prescribed temperature (e.g., about 180° C.) by detecting the temperature of the fixing belt 200 on the basis of the output of the temperature sensor 550 and adjusting the output of the induction heating power supply 530 on the basis of the detected temperature.

Basic operation of the fixing device 101 having the above construction is described. At the time of fixing, the pressure roller 300 rotates in the clockwise direction in the figure on the basis of the drive of a motor (not shown). The fixing belt 200 and the fixing roller 100 rotate in the counterclockwise direction in the figure on the basis of a friction force between the pressure roller 300 and the fixing belt 200 and a friction force between the fixing belt 200 and the fixing roller 100, respectively. In the electromagnetic induction heater 500, the induction heating power supply 530 applies a high frequency to the coil 510, and an alternating magnetic field is formed in a region surrounded by the coil 510. As a result, the fixing belt portion that passes through the region opposite to the coil 510 generates heat. The surface temperature of the fixing belt 200 is detected by the temperature sensor 550, and the controller 540 adjusts the output of the induction heating power supply 530 on the basis of the detection result, maintaining the surface temperature of the fixing belt 200 constant.

As illustrated, the sheet 400 that carries thereon the developer image (toner image) formed in the image forming section of the image forming apparatus is fed from the left side in the figure to the nip region where the fixing belt 200 and the pressure roller 300 are brought in contact with each other. The unfixed developer carried on the sheet 400 that is passing through the nip region is heated and melted by heat given from the fixing belt 200. The melted developer is fixed to the sheet 400 by a pressure exerted between the fixing roller 100 and the pressure roller 300. As illustrated, since the nip region is formed convex from the pressure roller 300 to the fixing roller 100, the leading end of the sheet 400 that has passed through the nip region is sent out toward an oblique lower right direction away from the fixing belt 200 in cooperation with the bending reluctance of the sheet 400. As a result, the sheet 400 is reliably separated from the fixing belt 200 and discharged to, for example, a copy receiving tray (not shown).

Although the electromagnetic induction heater 500 has been employed as the heating means of the fixing belt 200 in the above description, another heating means of, for example, electrification heating and heating by the irradiation of a halogen lamp may be used. When the halogen lamp is used as the heating means, the heating layer 210 may be made of a material that has does not have electrical conductivity. In the case, a resin layer of, for example, a PI (polyimide) layer having a thickness of 50 μm to 100 μm can be used in place of the heating layer 210.

The lengths in the lengthwise direction of the fixing roller 100, the pressure roller 300 and the fixing belt 200 in the present invention are described.

As described above, conventionally in the fixing device or another sheet conveying device which employs a soft fixing roller and a hard pressure roller and in which a nip region of a prescribed size is formed been the two, the lengths in the lengthwise direction of these two rollers are designed to be identical. However, there are the following problems in the case of the above design.

Figure 3A:
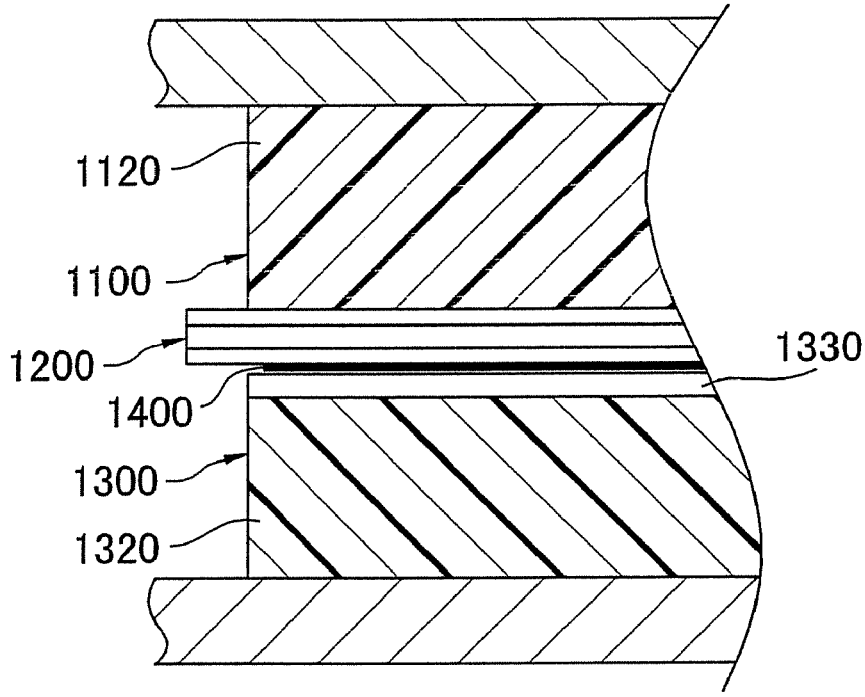
Fig.3A PRIOR ART
FIG. 3A is a sectional view of a lengthwise end portion of the roller in the nip region of a conventional fixing device, showing a state in which the fixing roller and the pressure roller are not put in pressure contact with each other.
Figure 3B:
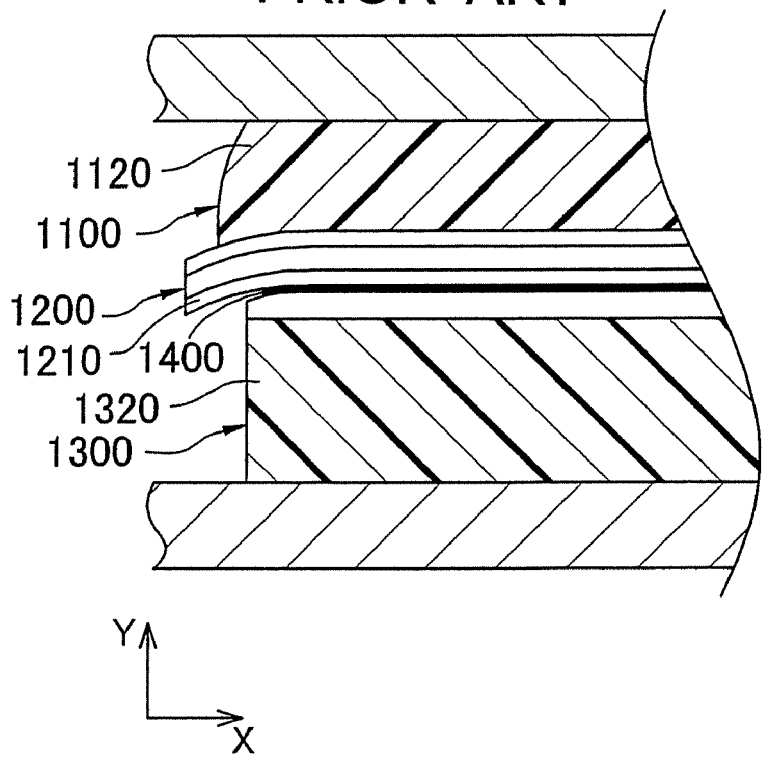
Fig.3B PRIOR ART
FIG. 3B is a sectional view of the lengthwise end portion of the roller in the nip region of the conventional fixing device, showing a state in which the fixing roller and the pressure roller are put in pressure contact with each other.

FIGS. 3A and 3B show a part of the conventional fixing device in which a fixing roller and a pressure roller having an identical length are placed with both ends aligned with each other. In the figures, FIG. 3A shows a state in which a fixing roller 1100 and a pressure roller 1300 are not put in pressure contact with each other, and FIG. 3B shows a state in which the soft fixing roller 1100 is deformed by being pressed in contact with the hard pressure roller 1300 pressurized against the soft fixing roller 1100. In the state in which the soft fixing roller 1100 and the hard pressure roller 1300 are not put in pressure contact with each other as shown in FIG. 3A, end portions 1120, 1320 of both the rollers 1100, 1300 are aligned with each other. However, in the state in which the soft fixing roller 1100 and the hard pressure roller 1300 are put in pressure contact with each other as shown in FIG. 3B, both the end portions (only the left end portion is shown) 1120 of the soft fixing roller 1100 outwardly expand. As a result, the end portion 1210 of the fixing belt 1200 held between the fixing roller 1100 and the pressure roller 1300 is bent toward the pressure roller 1300 by the expanded end portion 1120 of the fixing roller. In particular, when the end portion of a sheet 1400 is located inside an end portion 1320 of the pressure roller 1300 as illustrated, the amount of bend of the fixing belt 1200 is further increased. Moreover, pressurizing forces of the fixing roller 1100 and the pressure roller 1300 escape and diffuse in the direction of expansion (outwardly in the horizontal direction) in both end regions, so that the fixing force becomes insufficient at both end portions of the sheet 1400.

As a result, the fixing of the developer is insufficient or the disorder of the image occurs as a consequence of the movement of the unfixed developer toward the end portions in both end portions of the sheet 1400. In particular, since developers of a plurality of colors are layered on the sheet 1400 in a full-color image forming apparatus, it is often the case where the disorder of the image occurs. Moreover, when the fixing belt 1200 includes a metal layer (electromagnetic induction heating layer 1210), an excessive bending stress is generated in the metal layer, and cracks are sometimes generated.

In order to solve the above problems, in the fixing device 101 according to the present invention, as shown in FIG. 2, the hard pressure roller 300 is made longer than the soft fixing roller 100 and both ends of the outer peripheral portions (release layer 330 and elastic layer 320) of the pressure roller 300 are positioned outside both ends of the outer peripheral portion (elastic layer 120) of the fixing roller 100. Concretely, in the embodiment, a length L1 in the lengthwise direction X of the outer peripheral portion of the fixing roller 100 is 330 mm, and a length L2 in the lengthwise direction X of the outer peripheral portion of the pressure roller 300 is 336 mm so that, for example, an A3W sheet having a width of 311 mm can be fixed. That is, the length L1 is made shorter than the length L2. For example, an X-direction dimension L3 of the fixing belt is 340 mm. Moreover, the end portion of the outer peripheral portion of the fixing roller 100 is positioned 3 mm inside (in the X-direction of FIG. 2) the end portion of the outer peripheral portion of the pressure roller 300. Therefore, although not shown, the expanded end portion of the elastic layer 120 of the fixing roller 100 is located approximately in the same position as that of the end portion of the outer peripheral portion of the pressure roller 300 even when the fixing roller 100 and the pressure roller 300 are put in pressure contact with each other with a prescribed pressure. With this arrangement, the problems of the disorder of the image and the breakage of the metal layer described above are eliminated.

However, also varied depending on the pressure force of the fixing roller 100 and the pressure roller 300, the length L1 of the outer peripheral portion of the fixing roller 100 and the length L2 of the outer peripheral portion of the pressure roller 300 should preferably satisfy the following Equation (1).

$$2\text{ mm} \leqq L2 - L1 \leqq 10\text{ mm} \quad (1)$$

The length of projection of the outer peripheral portion of the pressure roller 300 in the lengthwise direction from both ends of the outer peripheral portion of the fixing roller 100 is not necessarily required to be same at the right and the left. However, also in this case, the length of projection of the pressure roller 300 from the end portion of the fixing roller 100 should preferably be about 1 mm to 5 mm.

Figure 4:
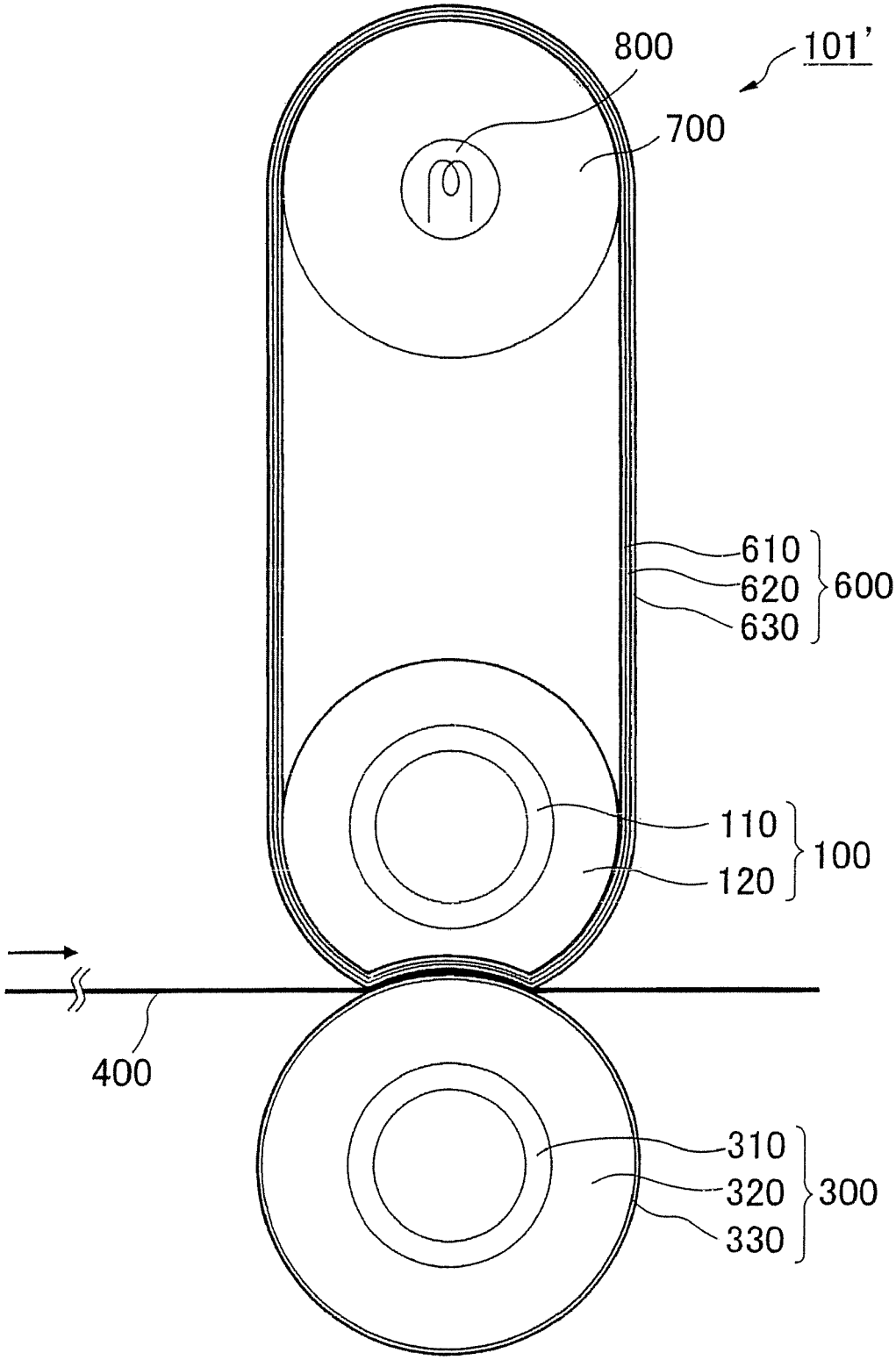
FIG. 4 is a side view of another fixing device according to the first embodiment of the present invention.

Although the fixing belt is supported by one roller (fixing roller) in the above description, the present invention includes a fixing device in a state in which the fixing belt is supported by a plurality of rollers as shown in FIG. 4. Concretely, in a fixing device 101' of the present embodiment, a fixing belt 600 is supported by a fixing roller 100 and a support roller 700. The fixing belt 600 has a structure of three layers (heating layer 610, elastic layer 620, release layer 630) as in the fixing belt 200 described above. Characteristics of the materials used for the heating layer 610, the elastic layer 620 and the release layer 630 and the thickness and so on are the same as those of the heating layer 210, the elastic layer 220 and the release layer 230, respectively, of the fixing belt 200. The fixing device 101' employs a halogen lamp 800 as heating means placed in the support roller 700. Therefore, no metal layer (induction heating layer) is needed for the fixing belt 600. The structures, materials and lengths of the fixing roller 100 and the pressure roller 300 are as described in connection with the fixing device 101.

Figure 5:
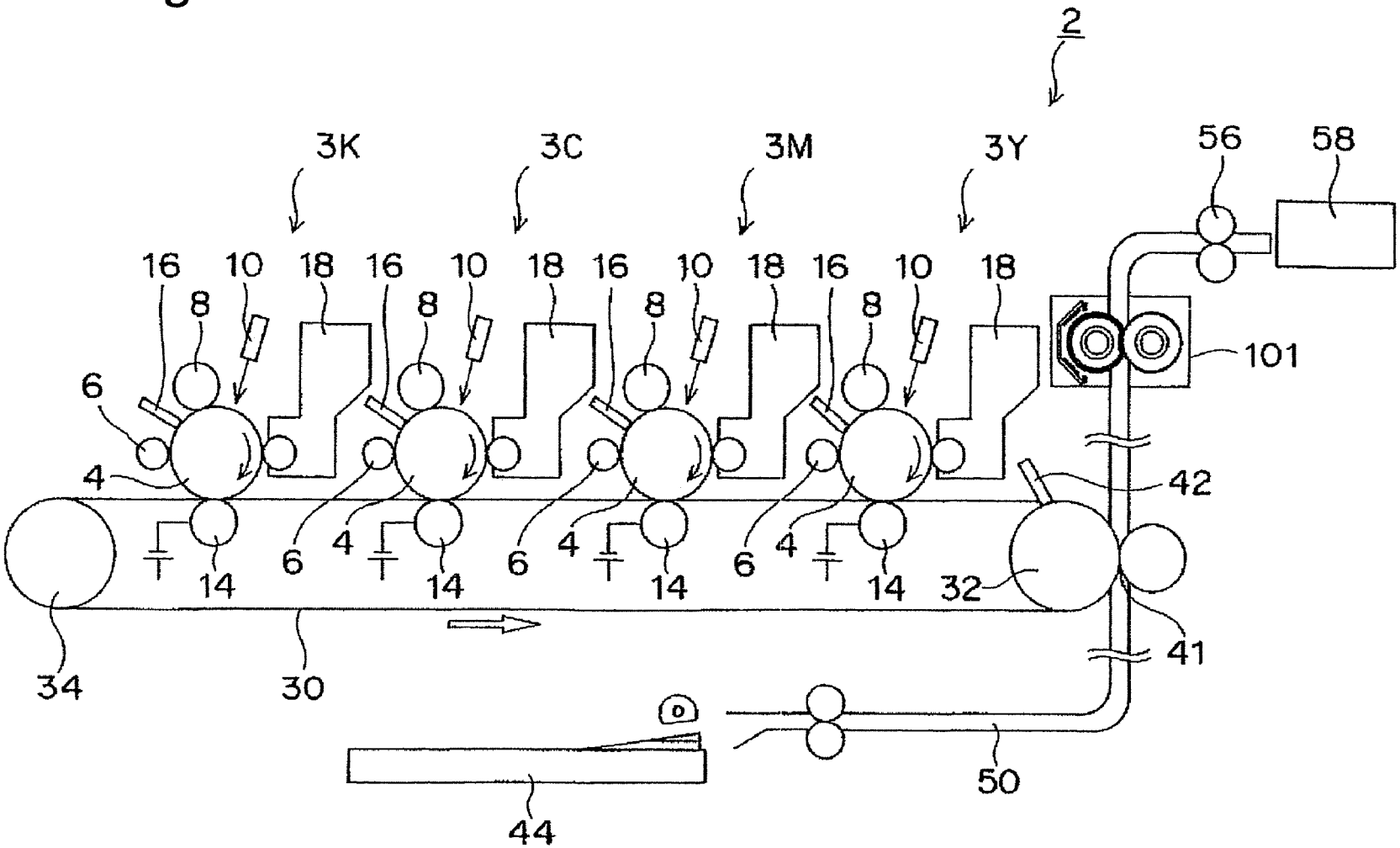
FIG. 5 is a sectional view of a image forming apparatus according to a first embodiment of the present invention.

An embodiment of the image forming apparatus that includes the above fixing device is described. FIG. 5 shows a full-color type electrophotographic image forming apparatus of a copying machine, a printer, a facsimile or a complex machine that has the functions of them in a complex form. It is noted that the housing of the image forming apparatus is omitted from the figure for the sake of facilitating the understanding of the invention by clarifying the characteristic portions of the present invention.

An image forming apparatus 2 is a so-called tandem system color image forming apparatus. It is noted that the present invention is not applied limitatively to this kind of image forming apparatus but allowed to be similarly applied to an image forming apparatus of another style of, for example, a so-called four-cycle system image forming apparatus that forms a full-color image by placing four developing units around the axis of rotation and making the units successively face an electrostatic latent image carrier or a monochrome image forming apparatus that has only one developing unit.

As illustrated, the image forming apparatus 2 has an endless intermediate transfer belt 30. The transfer belt 30 is supported by rollers 32, 34 placed at the right and the left in the figure. Either one of the rollers 32, 34 is operatively connected to a motor (not shown) and moved in the counterclockwise direction in the figure. Four image forming portions 3Y, 3M, 3C, 3K (generally denoted by the reference numeral 3) that form toner images of corresponding colors by using the respective developers of yellow (Y), magenta (M), cyan (C) and black (K) are arranged in order from the right side to the left side in the figure above a belt portion that moves from the roller 32 located on the right side in the figure toward the left side in the figure.

Each image forming portion 3 has a cylindrical photoconductor 4 as an electrostatic latent image carrier. Around the photoconductor 4 are arranged a charger 8, an exposure unit 10, a developing unit 18, a primary transfer roller 14, a lubricant applying unit 6 and a cleaning blade 16 in this order along the rotational direction (clockwise direction in the figure), and the primary transfer roller 14 is placed inside the endless intermediate transfer belt 30.

One example of the image forming operation in the color mode is described in brief. First of all, in each image forming portion 3, a lubricant is applied to the outer peripheral surface (image-carrying surface) of the photoconductor 4 that is rotationally driven at a prescribed circumferential velocity by the lubricant applying unit 6, and the remaining toner is removed by the cleaning blade 16. Thereafter, the photoconductor 4 is electrically charged by the charger unit 8. In the embodiment, a plate-shaped blade is employed as the photoconductor cleaning blade 16, and its one end side is put in contact with the outer peripheral surface of the photoconductor 4. Next, light corresponding to image information is projected from the exposure unit 10 to the outer peripheral surface of the charged photoconductor 4 to form an electrostatic latent image. Subsequently, the electrostatic latent image is actualized by the toner of the developer supplied from the developing unit 18 to form a toner image. The toner images of the colors thus formed on the photoconductor 4 are transferred (primarily transferred) from the photoconductor 4 onto the intermediate transfer belt 30 and superposed in the order of yellow, magenta, cyan and black when arriving at the primary transfer region by the rotation of the photoconductor 4.

The toner remaining on the photoconductor 4 without being transferred to the intermediate transfer belt 30 is removed from the outer peripheral surface of the photoconductor 4 by being wiped off by the cleaning blade 16 when arriving at a contact portion of the photoconductor 4 and the cleaning blade 16.

The four color toner images superposed on the intermediate transfer belt 30 are conveyed to a secondary transfer region 41 by the intermediate transfer belt 30. On the other hand, a sheet stored in a sheet feed cassette 44 is conveyed to a secondary transfer region 41 in accordance with the timing. Then, the toner images of the four colors are subjected to secondary transfer from the intermediate transfer belt 30 to the sheet in the secondary transfer region 41. The sheet, on which the toner images of the four colors have been transferred, is conveyed further to the downstream side of a conveyance path 50, the toner images are fixed on the sheet by the fixing device 101 that includes a high-frequency induction type heater and thereafter sent out to a copy receiving part 58 by a sheet ejecting roller 56. The intermediate transfer belt 30, which has passed through the secondary transfer region 41, is cleaned by a cleaning member 42. Thereafter, the rotational driving of the photoconductors 4 and the intermediate transfer belt 30 is stopped.

In the present image forming apparatus 2, by employing the fixing device 101, the occurrence of insufficient fixation at the end portion of the sheet is reduced even when the thickness of the toner particle layer is thick, and a variation in the pressurizing force applied to the sheet is reduced in the lengthwise direction X of the roller. Therefore, an image that is entirely uniform and clear can be obtained. Moreover, deformations of curves and the like are reduced at the end portions of the sheet.

The Second Embodiment

Figure 6:
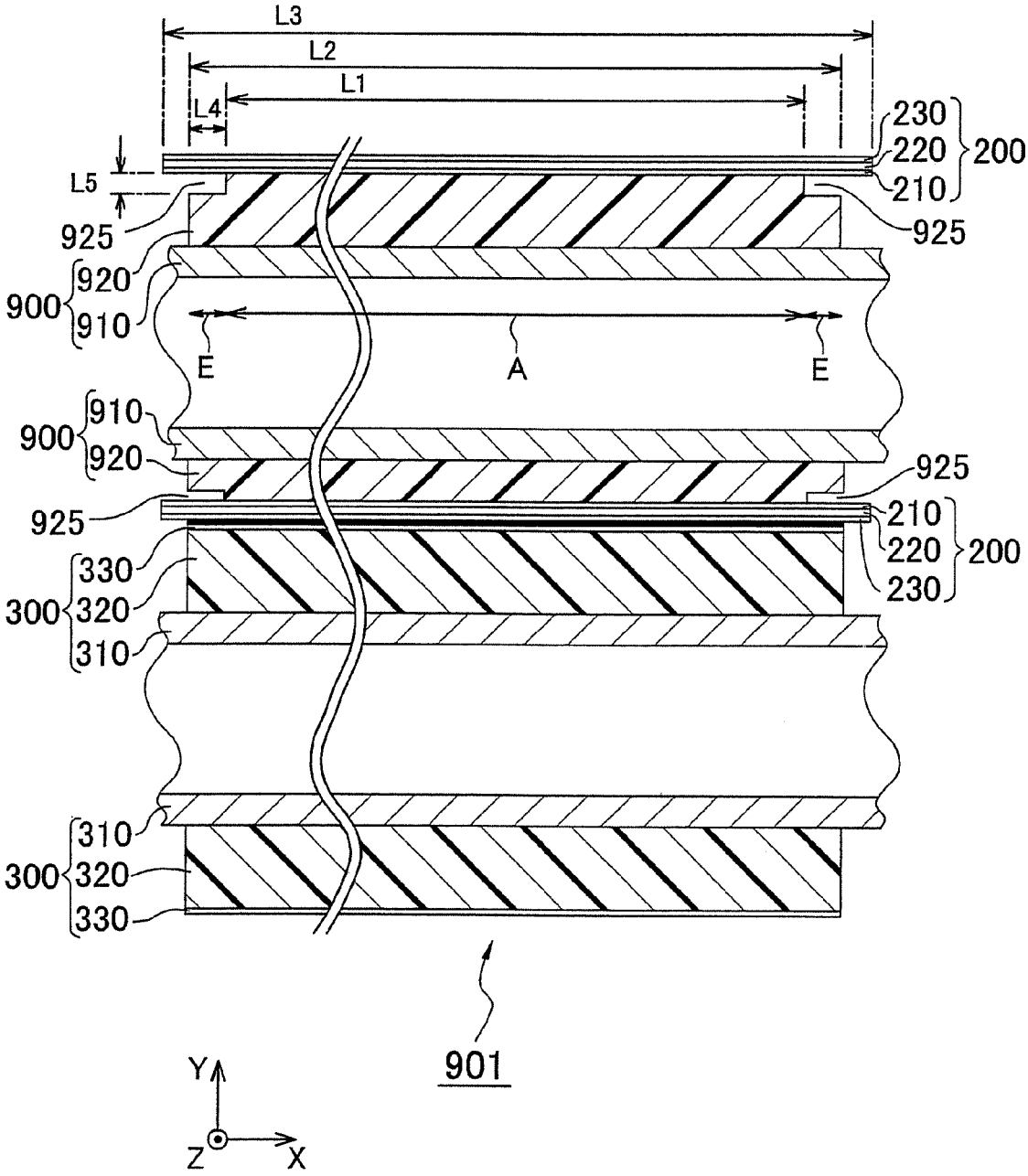
FIG. 6 is a sectional view showing a fixing device according to a second embodiment of the present invention having a recess portion that has a rectangular cross section in the elastic layer of the fixing roller.

FIG. 6 is a sectional view of a fixing device 901 according to the second embodiment of the present invention. The cross section of FIG. 6 contains in its plane the central axes (not shown) of two rollers 900, 300 described later. In the fixing device 901, the fixing roller 900 includes a core metal 910 and an elastic layer 920 that has a heat-insulating property and covers the outer peripheral surface of the core metal 910 as in the fixing roller 100 described in the first embodiment. The material used for the core metal 910 is the same as that of the core metal 110, and the material and hardness of the elastic layer 920 are the same as those of the elastic layer 120.

The elastic layer 920 has an annular recess portion 925 continuous in the circumferential direction of the outer peripheral portion in both end regions E other than a region A through which the sheet passes in the lengthwise direction X of the fixing roller 900 shown in FIG. 6. In this example, the recess portion 925 has a one-sided groove having a rectangular cross section shape such that the outside diameter dimension of the elastic layer 920 is reduced in a perpendicular step toward the outside in the lengthwise direction X. When the fixing roller 900 is molded by a metal mold, the recess portion 925 can be formed integrally with the fixing roller 900. Otherwise, it is acceptable to form the elastic layer 920 on the core metal 910 and thereafter form the recess portion 925 by removing the corner portions by, for example, cutting in both end regions E.

By adopting the construction as described above, in the fixing device 901 of the second embodiment, the length L1 in the lengthwise direction X of the outer peripheral portion of the fixing roller 900 is shorter than the length L2 in the lengthwise direction X of the outer peripheral portion of the pressure roller. It is noted that L1 and L2 should preferably satisfy the relation of the Equation (1) also in the present second embodiment.

If concrete dimensions are described, a length L4 (see FIGS. 6 and 7) of the recess portion 925 is 6 mm in the lengthwise direction X of the fixing roller 900, and the preferable range is 2 mm to 10 mm. A height L5 (see FIGS. 6 and 7) of the recess portion 925 is, for example, 2 mm, and the preferable range is 1 to 5 mm. These values are values in the state in which the fixing roller 900 is not put in pressure contact (receiving no pressure force).

With the above construction, it becomes possible to restrain the end portion of the outer peripheral portion of the fixing roller 900 that attempts to expand in the lengthwise direction X from expanding beyond filling up the recess portion 925 as the result that the fixing roller 900 and the pressure roller 300 are brought in pressure contact with each other via the fixing belt 200. With this arrangement, an excessive stress is prevented from being given to the fixing belt 900, and the problems of the disorder of the image and the breakage of the metal layer described above are eliminated.

The recess portion 925 should desirably be provided in both ends regions E of the outer peripheral portion of the fixing roller 900. However, in a case where the end portion of the outer peripheral portion of the pressure roller 300 is located outside the end portion of the outer peripheral portion of the fixing roller 900 or another case since the outer peripheral portion of the fixing roller 900 and the outer peripheral portion of the pressure roller 300 have varied center positions in the lengthwise direction or another reason, it is acceptable to provide the recess portion 925 only in one end region E of the outer peripheral portion of the fixing roller 900. Moreover, the length L1 in the lengthwise direction X of the outer peripheral portion of the fixing roller 900 should preferably be shorter than or equal to an X-direction dimension L3 of the fixing belt 300.

The Third Embodiment

Although the cross section of the recess portion 925 has the rectangular shape in FIG. 6, it is not limited to the shape. There may be a recess portion 926 that has a triangular cross section shown in FIG. 7A, a recess portion 927 that has a laterally U-shaped cross section shown in FIG. 7B, a recess portion 928 that has a trapezoidal cross section shown in FIG. 7C or a recess portion 929 that has a bird's beak-shaped cross section shown in FIG. 7D. It is noted that each of these recess portions 926, 927, 928, 929 has a form of an annular one-sided groove continuous in the circumferential direction as in the recess portion 925 shown in FIG. 6.

Figure 7A:
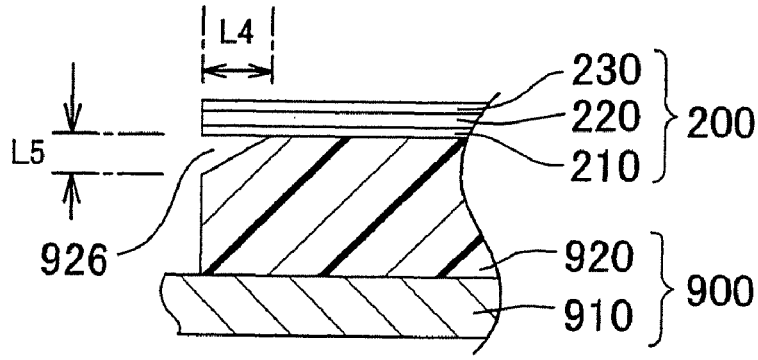
FIG. 7A is a view showing a recess portion that has a triangular cross section provided at the elastic layer of the fixing roller.

The recess portion 926 having the triangular cross section shown in FIG. 7A has an inclined portion of which the outside diameter dimension is linearly reduced outwardly in the lengthwise direction X. In this example, the inclined portion is inclined at an angle of not smaller than 20° or at an angle of 30° in this example with respect to the outer peripheral surface (original outer peripheral surface) of the elastic layer 920 in the region A through which the sheet passes (see FIG. 6). With this arrangement, a height (space) L5 of the recess portion 926 can easily be secured while suppressing the length L4 of the recess portion 926. Since the inclined portion is linear in the recess portion 926, processing and dimensional control of the elastic layer 920 become easy.

Figure 7B:
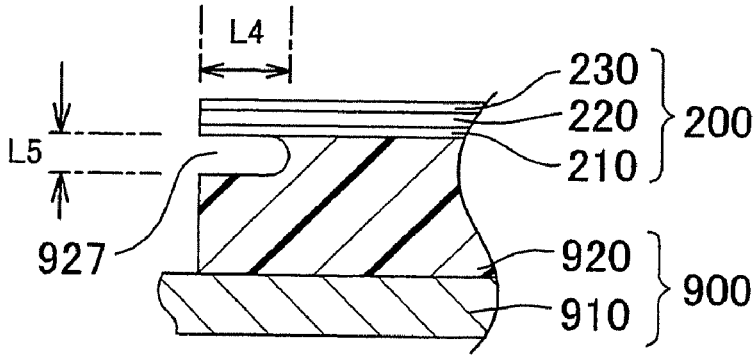
FIG. 7B is a view showing a recess portion that has a laterally U-shaped cross section provided at the elastic layer of the fixing roller.

The recess portion 927 shown in FIG. 7B has the laterally U-shaped cross section opened outwardly in the lengthwise direction X. With this arrangement, the space formed of the recess portion 927 can easily be secured.

Figure 7C:
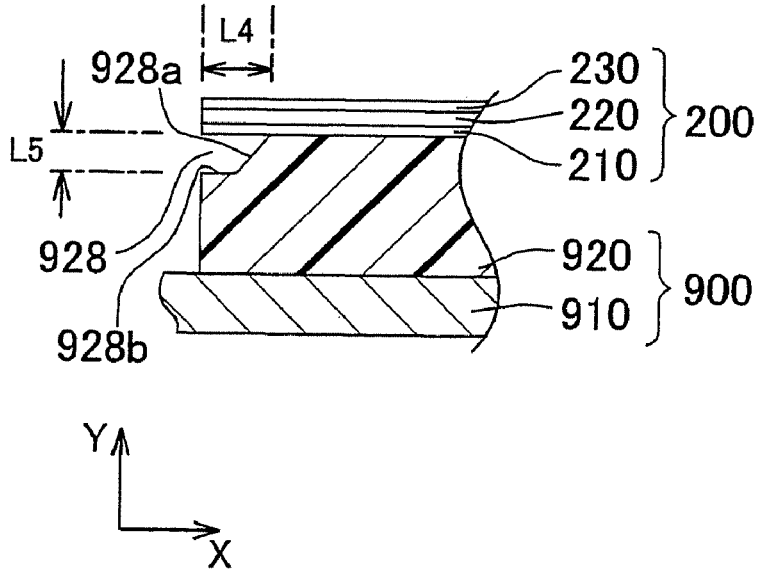
FIG. 7C is a view showing a recess portion that has a trapezoidal cross section provided at the elastic layer of the fixing roller.

The recess portion 928 having the trapezoidal cross section shown in FIG. 7C has an inclined portion 928*a* of which the outside diameter dimension is linearly reduced outwardly in the lengthwise direction X and a flat portion 928*b* which is outwardly continuous to the inclined portion 928*a* and of which the outside diameter dimension is constant. With this arrangement, the space formed of the recess portion 928 can easily be secured.

Figure 7D:
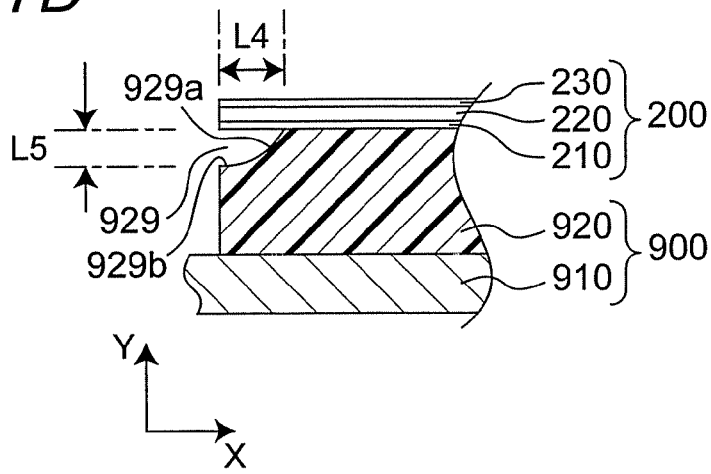
FIG. 7D is a view showing a recess portion that has a bird's beak-shaped cross section provided at the elastic layer of the fixing roller.

The recess portion 929 having the bird's beak-shaped cross section shown in FIG. 7D has an inclined portion 929*a* of which the outside diameter dimension is gradually reduced outwardly in the lengthwise direction X and a flat portion 929*b* which is outwardly continuous to the inclined portion 929*a* and whose outside diameter dimension is constant. With this arrangement, the space formed of the recess portion 929 can easily be secured.

With the recess portions 926, 927, 928, 929 provided, it becomes possible to restrain the end portion of the outer peripheral portion of the fixing roller 900 that attempts to expand in the lengthwise direction X from expanding beyond filling up the recess portions 926, 927, 928, 929 as the result that the fixing roller 900 and the pressure roller 300 are brought in pressure contact with each other via the fixing belt 200 as in the case where the recess portion 925 shown in FIG. 6 is provided. With this arrangement, an excessive stress is prevented from being given to the fixing belt 900, and the problems of the disorder of the image and the breakage of the metal layer described above are eliminated.

Next, the recess portion 928 having the trapezoidal cross section shown in FIG. 7C is described in detail.

Since the inclined portion 928*a* is linear in the recess portion 928, the processing and dimensional control of the elastic layer 920 become easy as in the case of the recess portion 926 shown in FIG. 7A.

Figure 8A:
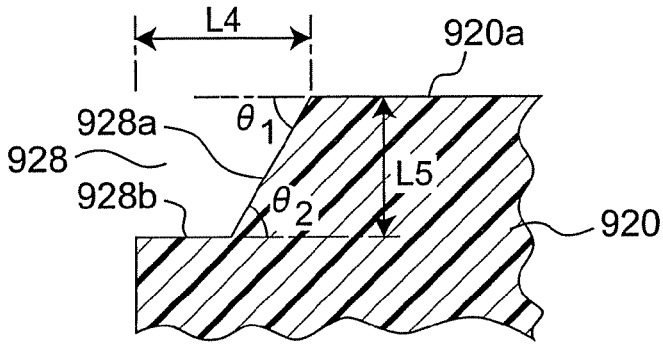
FIG. 8A is a view showing in detail the recess portion of FIG. 7C.

Moreover, as shown in FIG. 8A, the inclined portion 928*a* is bent at an angle $\theta_1$ of not smaller than 20° and not greater than 65° or at an angle $\theta_1$=61.3° in this example with respect to the original outer peripheral surface 920*a* of the elastic layer 920 in the recess portion 928. Since $\theta_1$ is not smaller than 20°, the height (space) L5 of the recess portion 928 can easily be secured while suppressing the length L4 of the recess portion 928. On the other hand, since $\theta_1$ is not greater than 65°, a shearing stress applied to the inclined portion 928*a* and its neighborhood portions of the elastic layer 920 is eased in comparison with, for example, a case where $\theta_1$ is 90° (recess portion 925 in FIG. 6) in the state in which the fixing roller 900 and the pressure roller 300 are brought in pressure contact with each other via the fixing belt 200. Therefore, the elastic layer 920 becomes able to endure being driven for a long time, and the reliability is improved. Moreover, the inclined portion of the elastic layer 920 is bent and raised at an angle $\theta_2$ that exceeds 0° and is not greater than 65° or at an angle $\theta_2$=61.3° (=$\theta_1$) with respect to the outer peripheral surface of the flat portion 928*b* of the elastic layer 920. Therefore, the shearing stress applied to the inclined portion 928*a* and its neighborhood portions of the elastic layer 920 is further eased. Therefore, the elastic layer 920 becomes able to endure being driven for a longer time, and the reliability is further improved.

Figure 13A:
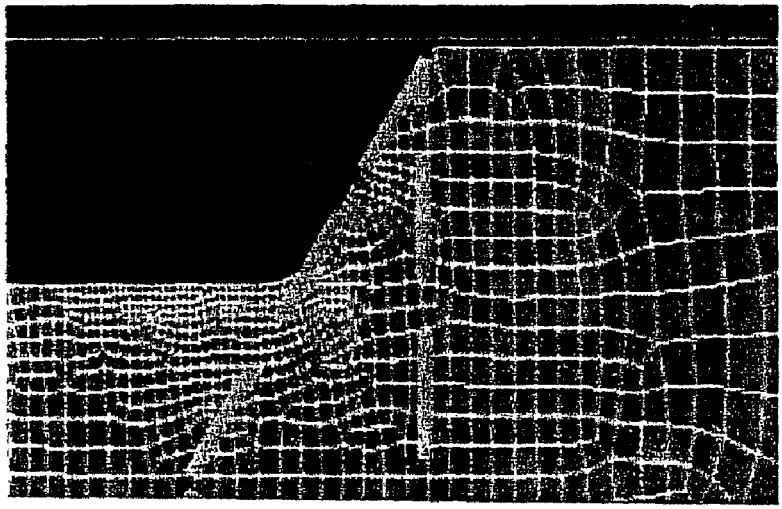
FIG. 13A is a view showing a state of the elastic layer before the fixing roller and the pressure roller are brought in pressure contact with each other via the fixing belt in the case where the recess portion shown in FIG. 7C is provided at the elastic layer.
Figure 13B:
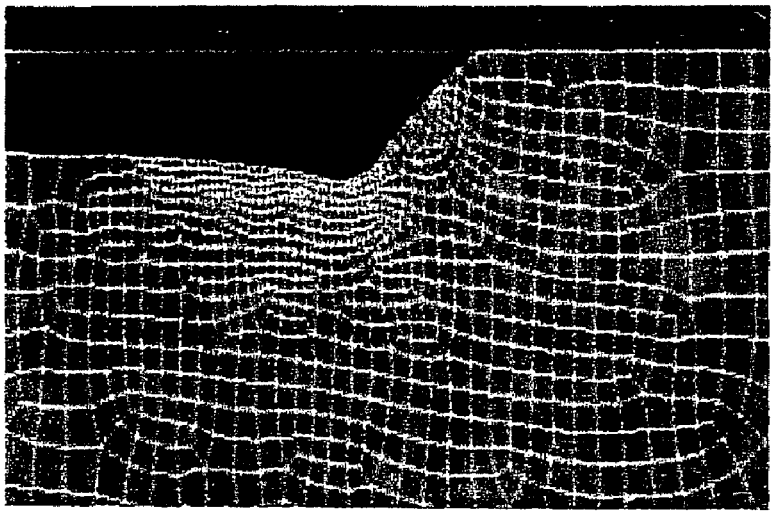
FIG. 13B is a view showing a state of the elastic layer after the fixing roller and the pressure roller have been brought in pressure contact with each other via the fixing belt in the case where the recess portion shown in FIG. 7C is provided at the elastic layer.

FIGS. 10 and 11 show the results of CAE (Computer Aided Engineering) analysis concerning the maximum strain and the maximum stress of the elastic layer 920 when the fixing roller 900 and the pressure roller 300 are brought in pressure contact with each other via the fixing belt 200. A result that the maximum principal strain and the maximum principal stress are further eased is obtained when the recess portion 928 shown in FIG. 7C is provided in comparison with the case where the recess portion 925 shown in FIG. 6 is provided. FIGS. 13A and 13B show the simulation results of the states of the elastic layer 920 before and after the fixing roller 900 and the pressure roller 300 are brought in pressure contact with each other via the fixing belt 200 when the recess portion 928 shown in FIG. 7C is provided. The meshes in FIGS. 13A and 13B are virtually set to show the movements of portions of the elastic layer 920. It can be understood from FIGS. 13A and 13B that the stress due to the pressure contact is successfully diffused.

Moreover, FIG. 12 shows the results of durability when the fixing device is continuously driven by comparison depending on the unattended case of "no recess portion", the case where the recess portion 925 shown in FIG. 6 is provided and the case where the recess portion 928 shown in FIG. 7C is provided. In the case of "no recess portion", the belt metal layer was destroyed through a continuous drive of about two hours. In the case where the recess portion 925 shown in FIG. 6 was provided, a continuous drive of about 320 hours could be achieved until the elastic layer 920 was broken. In the case where the recess portion 928 shown in FIG. 7C was provided, no trouble occurred through a continuous drive of 1000 hours. As described above, the effects of providing the recess portion 925 and the recess portion 928 were confirmed.

Figure 8B:
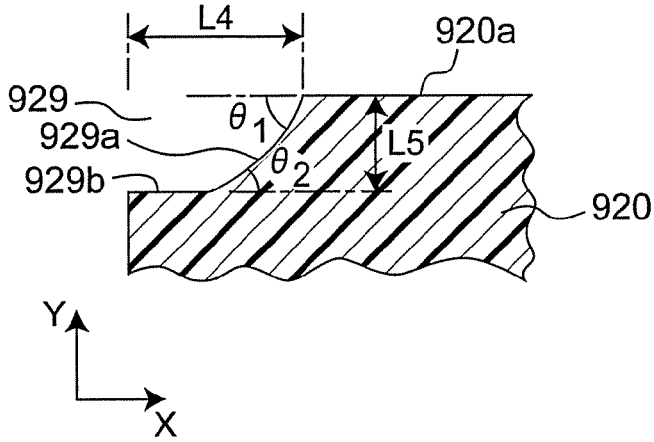
FIG. 8B is a view showing in detail the recess portion of FIG. 7D.

The effect of easing the shearing stress applied to the inclined portion and its neighborhood portions of the elastic layers 920 is also obtained by the recess portion 929 that has the bird's beak-shaped cross section shown in FIG. 7D. As shown in FIG. 8B, the inclined portion 929*a* is bent at the angle $\theta_1$ of not smaller than 20° and not greater than 65° or at the angle $\theta_1$=61.3° in this example with respect to the original outer peripheral surface 920*a* of the elastic layer 920 in the recess portion 929. Since $\theta_1$ is not smaller than 20°, the height (space) L5 of the recess portion 929 can easily be secured while suppressing the length L4 of the recess portion 929. On the other hand, since $\theta_1$ is not greater than 65°, a shearing stress applied to the inclined portion 929*a* and its neighborhood portions of the elastic layer 920 is eased in comparison with, for example, a case where $\theta_1$ is 90° (recess portion 925 in FIG. 6) in the state in which the fixing roller 900 and the pressure roller 300 are brought in pressure contact with each other via the fixing belt 200. Therefore, the elastic layer 920 becomes able to endure being driven for a long time, and the reliability is improved. Moreover, the inclined portion 929*a* of the elastic layer 920 is bent and raised with respect to the outer peripheral surface of the flat portion 929*b* of the elastic layer 920 (note that the inclined portion 929*a* may be bent and raised at the angle $\theta_2$ that exceeds 0° and is not greater than 65°). Therefore, the shearing stress applied to the inclined portion 929*a* and its neighborhood portions of the elastic layer 920 is further eased. Therefore, the elastic layer 920 becomes able to endure being driven for a longer time, and the reliability is further improved.

Figure 9:
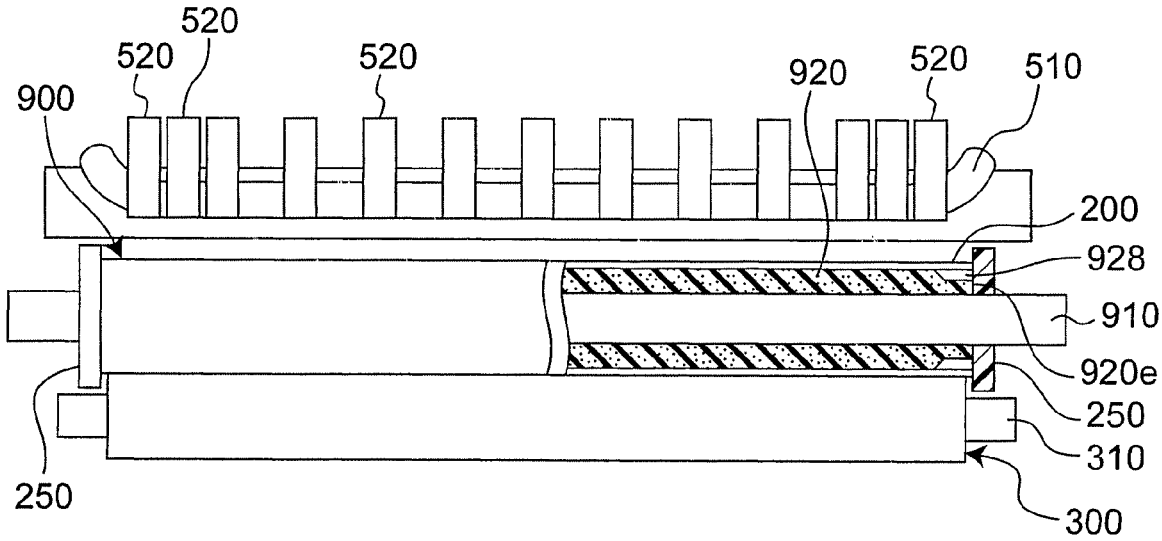
FIG. 9 is a view showing a state in which a meander regulation member is brought in contact with an outer end surface of the elastic layer of the fixing roller.

Moreover, the recess portion 928 shown in FIG. 7C and the recess portion 929 shown in FIG. 7D have the flat portions 928*b*, 929*b* of which the outside diameter dimension is constant outwardly in the lengthwise direction X as in the recess portion 927 shown in FIG. 7B. In this case, the outside diameter dimension of an outer end surface 920*e* of the elastic layer 920 can easily be secured to a certain extent as shown in, for example, FIG. 9. Therefore, a meander regulation member 250 for preventing the meander of the fixing belt 200 can easily be positioned in contact with the outer end surface 920*e* of the elastic layer 920. With this arrangement, the meander of the fixing belt 200 can effectively be prevented.

Although the examples in which the present invention is applied to the fixing device have been described in the first, second and third embodiments, the present invention can also be provided for a device for conveying a sheet or a belt-shaped member (strip), a device for conveying an object and also heating an object to be conveyed, a device for coating of an object to be conveyed, and a device for attaching another object to an object to be conveyed. Then, even in such conveying devices, changes in the pressurizing force in the lengthwise direction of the object to be conveyed due to rollers can be reduced, and curves of the side end portions of the object to be conveyed and the belt in the lengthwise direction of the rollers attributed to a difference in hardness between the two rollers can be eliminated.

The present invention is, of course, applicable to a conveying device for conveying a sheet to the fixing device in the image forming apparatus.

The invention being thus described, it will be obvious that the same may be varied in many ways. Such variations are not be regarded as a departure from the spirit and scope of the invention, and all such modifications as would be obvious to one skilled in the art are intended to be included within the scope of the following claims.

The invention claimed is:

1. A conveying device comprising:

a cylindrical first roller;

a cylindrical second roller that has a surface hardness higher than a surface hardness of the first roller; and a belt placed in a state surrounding either the first roller or the second roller, the conveying device moving an object to be conveyed by bringing the first roller and the second roller in pressure contact with each other via the belt and making the object pass through a nip portion formed of the belt and the first roller or the second roller facing the belt, wherein a length in a lengthwise direction of an outer peripheral portion of the first roller is shorter than a length in a lengthwise direction of an outer peripheral portion of the second roller, and a difference between the length in the lengthwise direction of the outer peripheral portion of the first roller and the length in the lengthwise direction of the outer peripheral portion of the second roller is not smaller than 2 mm.

2. The conveying device as claimed in claim 1, wherein the belt is tensionally looped over the first roller or the second roller and a third roller.

3. An image forming apparatus comprising the conveying device claimed in claim 1.

4. A fixing device comprising:

a cylindrical fixing roller;

a cylindrical pressure roller that has a surface hardness higher than a surface hardness of the fixing roller; and a fixing belt placed in a state surrounding an outer peripheral surface of the fixing roller, the fixing device fixing toner particles on a sheet by making the sheet that has a toner image on it pass through a nip portion formed of the pressure roller and the fixing belt by bringing the fixing roller and the pressure roller in pressure contact with each other via the fixing belt, wherein a length in a lengthwise direction of an outer peripheral portion of the fixing roller is shorter than a length in a lengthwise direction of an outer peripheral portion of the pressure roller, and the outer peripheral portion of the fixing roller has a recess portion in an end region other than a region where the sheet passes in the lengthwise direction, and the length in the lengthwise direction of the outer peripheral portion of the fixing roller is shorter than the length in the lengthwise direction of the fixing belt.

5. The fixing device as claimed in claim 4, wherein the fixing belt is tensionally looped over the fixing roller and a support roller.

6. The fixing device as claimed in claim 4, wherein a difference between the length in the lengthwise direction of the outer peripheral portion of the fixing roller and the length in the lengthwise direction of the outer peripheral portion of the pressure roller is not smaller than 2 mm.

7. The fixing device as claimed in claim 4, wherein the surface hardness of the fixing roller is within a range of 10 degrees to 30 degrees by Asker C hardness, and the surface hardness of the pressure roller is within a range of 50 degrees to 80 degrees by the Asker C hardness.

8. The fixing device as claimed in claim 4, wherein the outer peripheral portion of the fixing roller comprises foam of resin or rubber as an elastic layer.

9. The fixing device as claimed in claim 4, comprising:

an electromagnetic induction type heating part to heat the fixing belt.

10. The fixing device as claimed in claim 4, wherein a length and a height of the recess portion provided in the end region of the outer peripheral portion of the fixing roller are not smaller than 2 mm and not smaller than 1 mm, respectively, in a cross section that contains a central axis of the fixing roller and is parallel to the lengthwise direction.

11. An image forming apparatus comprising the fixing device claimed in claim 4.

12. A fixing device comprising:

a cylindrical fixing roller;

a cylindrical pressure roller that has a surface hardness higher than a surface hardness of the fixing roller; and a fixing belt placed in a state surrounding an outer peripheral surface of the fixing roller, the fixing device fixing toner particles on a sheet by making the sheet that has a toner image on it pass through a nip portion formed of the pressure roller and the fixing belt by bringing the fixing roller and the pressure roller in pressure contact with each other via the fixing belt, wherein a length in a lengthwise direction of an outer peripheral portion of the fixing roller is shorter than a length in a lengthwise direction of an outer peripheral portion of the pressure roller, and the length in the lengthwise direction of the outer peripheral portion of the fixing roller is shorter than a width of the fixing belt.

13. A fixing device comprising:

a cylindrical fixing roller;

a cylindrical pressure roller that has a surface hardness higher than a surface hardness of the fixing roller; and a fixing belt placed in a state surrounding an outer peripheral surface of the fixing roller, the fixing device fixing toner particles on a sheet by making the sheet that has a toner image on it pass through a nip portion formed of the pressure roller and the fixing belt by bringing the fixing roller and the pressure roller in pressure contact with each other via the fixing belt, wherein a length in a lengthwise direction of an outer peripheral portion of the fixing roller is shorter than a length in a lengthwise direction of an outer peripheral portion of the pressure roller, the outer peripheral portion of the fixing roller comprises foam of resin or rubber as an elastic layer, and the elastic layer of the fixing roller comprises an inclined portion whose outside diameter dimension is continuously reduced outwardly in the lengthwise direction in both end regions other than a region where the sheet passes in the lengthwise direction.

14. The fixing device as claimed in claim 13, wherein the elastic layer of the fixing roller comprises a flat portion which is outwardly continuous to the inclined portion and whose outside diameter dimension is constant in both end regions other than the region where the sheet passes in the lengthwise direction.

15. The fixing device as claimed in claim 14, wherein the inclined portion is bent at an angle of not smaller than 20° and not greater than 65° with respect to the outer peripheral surface of the elastic layer in the region where the sheet passes in a cross section that contains the central axis of the fixing roller and is parallel to the lengthwise direction.

16. The fixing device as claimed in claim 14, wherein the inclined portion of the elastic layer is bent or bent and raised in a curve at an angle that exceeds 0° and is not greater than 65° with respect to an outer peripheral surface of the flat portion of the elastic layer in a cross section that contains the central axis of the fixing roller and is parallel to the lengthwise direction.

17. The fixing device as claimed in claim 13, wherein the inclined portion of the elastic layer is linear in a cross section that contains the central axis of the fixing roller and is parallel to the lengthwise direction.

* * * * *